United States Patent [19]

Hisatomi

[11] 4,008,696

[45] Feb. 22, 1977

[54] CARBURETOR FOR OPTIMUM CONTROL OF AN AIR-FUEL MIXTURE SUPPLY TO THE ENGINE DURING DECELERATION

[75] Inventor: Takashi Hisatomi, Yokohama, Japan

[73] Assignee: Nissan Motor Co., Ltd., Yokohama, Japan

[22] Filed: Mar. 13, 1975

[21] Appl. No.: 557,946

[30] Foreign Application Priority Data

Mar. 19, 1974 Japan ..... 49-31143

[52] U.S. Cl. ..... 123/97 B; 261/DIG. 19

[51] Int. Cl.² ..... F02D 31/00

[58] Field of Search ..... 123/97 B, 124 B; 261/DIG. 1, DIG. 19

[56] References Cited

UNITED STATES PATENTS

| | | | |
|---|---|---|---|
| 2,036,205 | 4/1936 | Ericson | 123/97 B |
| 2,443,465 | 6/1948 | Leibing | 261/DIG. 19 |
| 2,824,726 | 2/1958 | Dietrich et al. | 261/DIG. 19 |
| 2,879,756 | 3/1959 | Cornelius | 261/DIG. 19 |
| 2,957,463 | 10/1960 | Schnabel | 123/97 B |
| 3,336,012 | 8/1967 | Walker | 261/DIG. 19 |
| 3,447,516 | 6/1969 | Bartholomew | 261/DIG. 19 |
| 3,503,594 | 3/1970 | Goto | 261/DIG. 19 |
| 3,690,305 | 12/1972 | Shimada et al. | 123/97 B |
| 3,756,208 | 9/1973 | Toda et al. | 123/97 B |
| 3,852,391 | 12/1974 | Hisatomi et al. | 261/DIG. 19 X |

*Primary Examiner*—Wendell E. Burns
*Assistant Examiner*—William Randolph

[57] ABSTRACT

Addition of most fuel is electrically prevented during braking by the engine at a high engine speed. Below a certain engine speed, the electric signal is stopped and a vacuum operated valve allows additional air-fuel mixture to enter the engine, even though the throttle valves are closed.

5 Claims, 5 Drawing Figures

CARBURETOR FOR OPTIMUM CONTROL OF AN AIR-FUEL MIXTURE SUPPLY TO THE ENGINE DURING DECELERATION

BACKGROUND OF THE INVENTION

This invention relates generally to an internal combustion engine and particularly to an improved carburetor for optimum control of an air-fuel mixture supply to the engine.

It is widely recognized that abnormally high emission of hydrocarbons occur in the engine exhaust under deceleration where the engine is acting as a brake and the throttle valve is fully closed. There are several interdependant reasons for this: Owing to a high vacuum in the intake manifold, a considerable amount of exhaust gas is drawn back into the cylinders so that the combustible mixture is too lean for normal ignition. Besides, the quantity of mixture fed into each cylinder is reduced to a minimum, which again results in failure in firing of the mixture. Thus the products of incomplete combustion containing a high concentration of free hydrocarbons are discharged with the exhaust gases into the atmosphere.

In order to meet the severe statutory requirements for emission control, there is an increasing tendency to equip internal combustion engine driven vehicles with catalytic converters for treating engine exhausts. The unburned hydrocarbons admitted into the catalytic converter produce reaction heat upon oxidization therein. Due to the heat, the operating temperature of the catalyst rises to an abnormal level, with the result that the activity of the catalyst falls and often the catalyst itself is damaged. Accordingly, minimization of the production of unburned hydrocarbons prior to the engine exhaust cleaning system is required from the standpoint of emission control.

There have been proposed a number of solutions to this problem, one of which is to arrange for an additional or supplementary mixture to be admitted downstream of the throttle valve for reduction of vacuum and for complete combustion of fuel. One exemplary arrangement of this is a by-pass passage for additional mixture provided within the carburetor, the passage being opened by a valve sensitive to high vacuum in the intake manifold to allow additional mixture into the intake manifold. There is another example wherein the throttle valve normally substantially closed upon engine deceleration is mechanically moved to a position of greater opening when the manifold vacuum exceeds a predetermined level.

These arrangements are, however, accompanied by some drawbacks: the supply of additional mixture reduces the braking effect of the engine and therefore badly affects the riding qualities when the vehicle is running down a hill. Also, it is undesirable in terms of fuel economy to consume fuel throughout deceleration. If the quantity of additional mixture is so limited as to maintain the manifold vacuum at a certain level for the purpose of reducing fuel consumption, not only is the quantity of mixture insufficient for full combustion but sufficient compression pressure for firing cannot build up when the manifold vacuum exceeds that level. This results in misfiring and therefore emission of hydrocarbons.

There is another proposal directed to engine exhaust control during deceleration in which, in contrast to the teaching of supplying additional mixture as described above, the mixture supply through any passageway including idle or slow port is completely cut off as long as the engine is driven by the vehicle with the throttle valve closed, thereby eliminating emission of unburned hydrocarbons. While fuel consumption may be minimized by this expedient, this has been proved impractical because, after the engine speed is decreased to appropriately idling speed in the progress of deceleration, or when the deceleration occurs at a relatively low vehicle speed as is rather usual when the vehicle is running on an urban street, the engine tends to stall due to the lack of combustible mixture. Thus, the fuel deposited on the walls of the intake system is discharged in a form of toxic unburned gas into the atmosphere.

OBJECTS OF THE INVENTION

Accordingly, it is one of the objects of the present invention to provide a novel and useful improved carburetor for reducing incomplete combustion products in an internal combustion engine throughout deceleration where the engine acts as a brake, with minimized fuel consumption.

Another object of the present invention lies in the provision of an improved carburetor by which whilst the supply of the air-fuel mixture is cut off whenever the engine is driven by the vehicle at high engine speed with the throttle valve closed, additional mixture is supplied to the cylinders when the engine is still driven by the vehicle but at a lower engine speed.

Still another object of the present invention is to provide the carburetor of the character above which can be used with an engine equipped with an exhaust treating catalytic converter to prevent damage to the catalyst by unburned hydrocarbons and the like.

Other objects are provision of good and secure braking by the engine, preventing engine troubles such as stalling, and providing fine driving qualities of the vehicle driven by the engine having the carburetor of this invention.

These and other objects, features and advantages of the present invention will become more apparent when taken with the accompanying drawings wherein a preferred embodiment of the present invention is shown.

Figure 1:
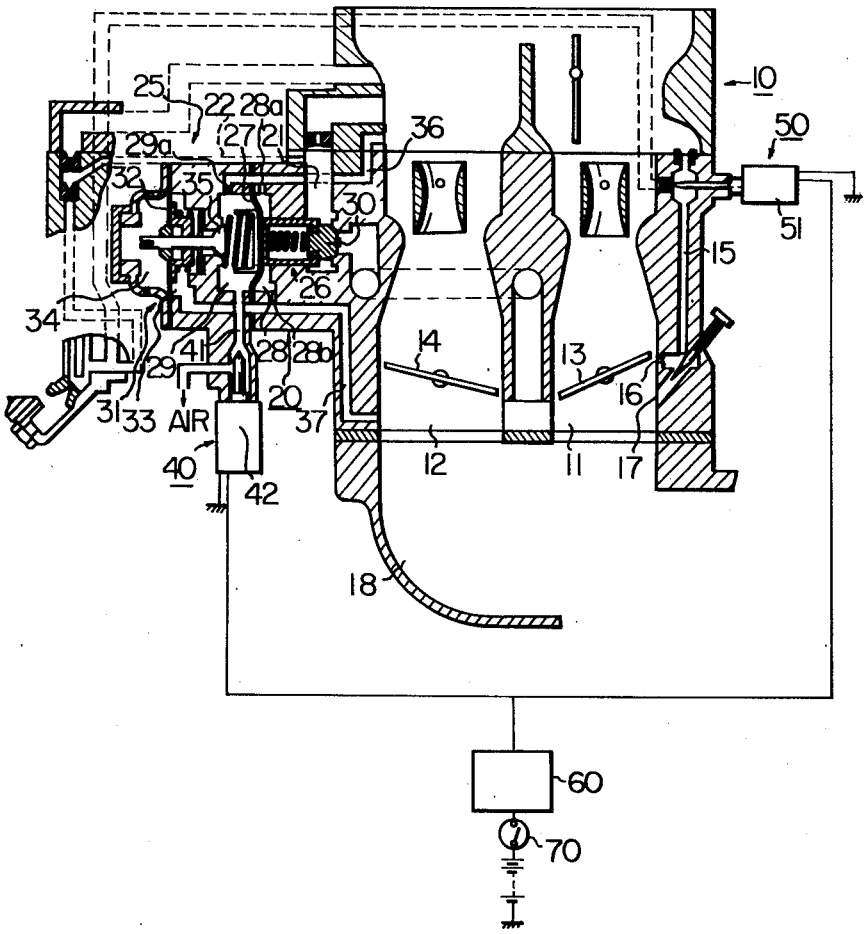
FIG. 1 is a view in section of an improved carburetor and intake manifold assembly according to this invention, illustrating one mode of operation.
Figure 2:
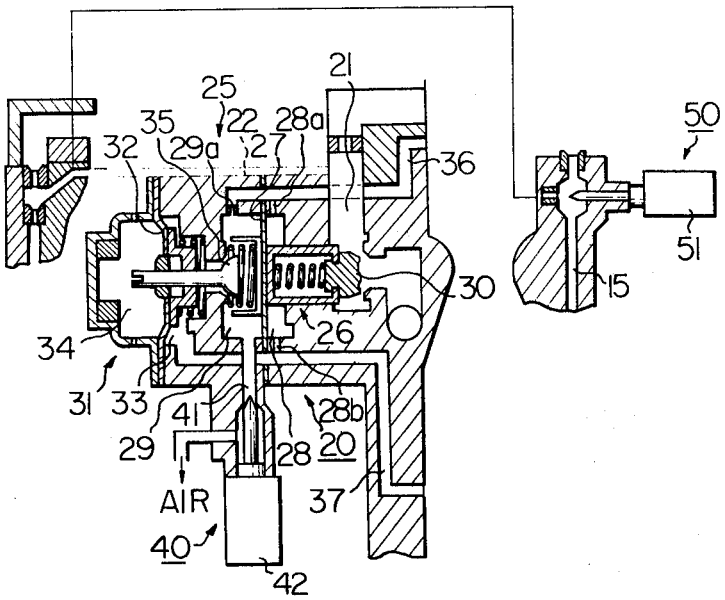
FIG. 2 is a fragmentary partial view of the carburetor shown in FIG. 1, illustrating another mode of operation.
Figure 3A:
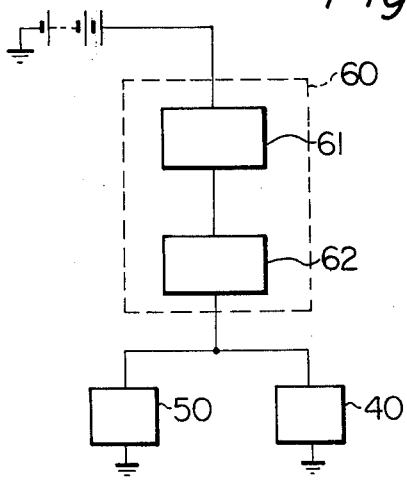
Figure 3B:
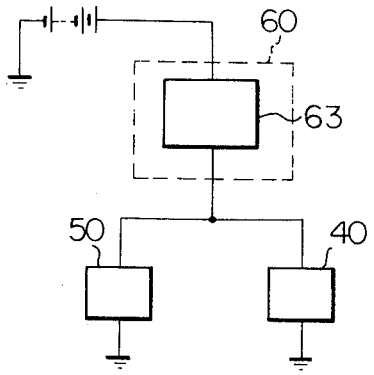
Figure 3C:
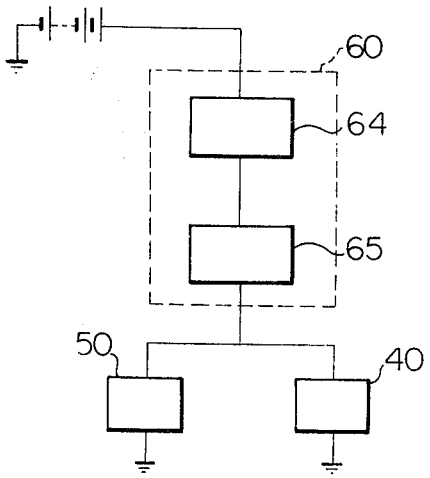

FIG. 3(*a*), (*b*) and (*c*) are views diagrammatically showing three alternative embodiments of a control system for use with the carburetor of FIGS. 1 and 2.

DESCRIPTION OF THE PREFERRED EMBODIMENTS

With reference to FIG. 1, the carburetor shown is indicated generally by 10. By way of illustration, the shown carburetor 10 is of the dual barrel type and thus includes two induction passages 11 and 12, the induction passages having butterfly type throttle valves 13 and 14 therein. Whilst the embodiment using a dual barrel carburetor is illustrated, it will be readily understood that the improvement of the present invention is feasible for a carburetor of a single barrel type or of any other type. The induction passages 11 and 12 conventionally communicates with an engine intake manifold 18.

In accordance with conventional practice, each induction passage is supplied with an air-fuel mixture through a main mixture supply passage, not shown. For light load or idling operation of the engine, a slow fuel supply passage 15 opens in the vicinity of the substantially closed throttle valve 13 through a slow port 16 and an idle port 17.

The mixture supply control according to the present invention will be hereinafter described. The improved carburetor comprises an additional mixture supply system indicated by 20, an actuating means 40 for the system 20 and a fuel supply cut off means 50. The actuating means 40 and cut-off means 50 are operably connected with an electric control means 60, the arrangement and operation of which will be later described.

The additional mixture supply system 20 comprises a by-pass passage 21 which leads from upstream of the throttle valve 14, the outlet port thereof (no number) opening into the inlet of the intake manifold 18 downstream of the throttle valves 13 and 14 at a location between the two induction passages 11 and 12. A valve assembly generally depicted by 25 is disposed in the by-pass passage 21 to block it under conditions that will be described later. A fuel conduit 22 leading from a fuel tank (not shown) opens into the passage 21 upstream the valve assembly 25 so that the air-fuel mixture is formed before passing the valve assembly 25.

The valve assembly 25 consists of a diaphragm-operated main valve 26 and a diaphragm-operated pilot valve 31. The main valve 26 has, as is conventional, a spring-loaded diaphragm 27 and two chambers 28 and 29 on opposite sides of the diaphragm. A valve head 30 is fixed to the diaphragm by means of a slidable valve support (no numeral), the valve head 30 bearing against its seat (no numeral) formed on the inner surface of the passage 21 for blocking it. The chamber 28 communicates through a calibrated orifice 28*a* with an air passage 36 which in turn communicates upstream of the throttle valve 14 to permit air into chamber 28. The chamber 28 has another calibrated orifice 28*b* the diameter of which is even smaller than that of the orifice 28*a*, the orifice 28*b* in turn communicating downstream of the throttle valve 14 through a vacuum passage 37. The orifice 28*b* serves to bleed off fuel which occasionally enters the chamber 28 from the passage 21 through a narrow clearance between the previously mentioned valve support and the housing wall enclosing it. The chamber 29 is communicable with the atmosphere depending upon the operation of the actuating means 40 as will be described later. The chamber 29 also has a calibrated orifice 29*a* which communicates with the air passage 36.

The pilot valve 31 serves to prevent hunting of the main valve 26 and includes a diaphragm 32, two chambers 33 and 34 disposed on opposite sides of the diaphragm, one chamber 34 being vented to the atmosphere through unnumbered orifices. The chamber 33 communicates downstream of the throttle valve 14 through the passage 37 for sensing the vacuum. Chamber 33 is communicable with the chamber 29 of the main valve 26 via a valve 31 the head 35 of which is fixed to the diaphragm 32 which is movable to cut off communication between the chambers 33 and 29.

The actuating means 40 referred to previously comprises a solenoid valve 42 which is disposed in an air bleed 41 opening into the chamber 29, the latter being fed with atmospheric air upon opening of the solenoid valve 42.

Another solenoid valve 51 which constitutes the fuel supply cut off means 50 is provided in the slow fuel passage 15 to open and close it.

The both solenoid valves 42 and 51 are connected with and are optimumly operated by the control unit 60 in a manner hereinafter described.

With particular reference to FIG. 3 which shows three alternative circuit arrangements of the control unit 60, one exemplified by FIG. 3(*a*) comprises an engine speed responsive switch 61 and a throttle valve position responsive switch 62 being connected in series to each other. The switch 61 is designed to be closed when the engine speed exceeds a predetermined value, whereas the switch 62 is closed upon substantially fuel closure of the throttle valve 13. In the example shown in FIG. 3(*b*), a manifold vacuum responsive switch 63 alone is provided to be closed at the manifold vacuum being above a predetermined value. Another example of the control unit shown in FIG. 3(*c*) has both an engine speed responsive switch 64 and a vacuum responsive switch 65 serially connected to one another.

Throughout all these embodiments, the outputs of the switches are connected to the actuating means 40 and the fuel supply cut off means 50, and the inputs thereof are connected to a battery (no numeral) or other source of power by way of an engine ignition switch 70 as depicted in FIG. 1. The switches being employed may be of whatever type capable of sensing the aforementioned engine operation parameters to produce a signal corresponding to each parameter.

OPERATION

In the embodiment of FIG. 3(*a*) the engine speed causing closing of the switch 61 is, for instance, 1600 rpm. This value of the engine speed may be varied and should be optimumly selected with respect to various factors such as the vehicle speed at which deceleration occurs most frequently. The switch 62 is closed when the throttle valve 13 is fully closed as described above, whereupon the throttle valve 14 is of course closed. Thus, the control unit of FIG. 3(*a*) is actuated and both the switches 61 and 62 are closed.

The switch 63 of FIG. 3(*b*) is closed, for instance, at a manifold vacuum of approximately −560 to −600 mmHg. Whilst the switch closing level of vacuum may also depend upon which type and construction of engine is used, the experiments conducted by the inventor revealed that the optimum level is −80 mmHg plus the vacuum level obtained during idling operation of the particular engine in use. Inasmuch as the manifold vacuum is influenced by environmental factors such as atmospheric pressure and ambient temperature, it is preferable to equip the unit of this embodiment with a climatic control.

Whilst in case of the embodiment of FIG. 3(*c*) the switch responding to engine speed is set to 1600 rpm to close like in the embodiment of FIG. 3(*a*), the manifold vacuum should be −520 to −560 mmHg which is lower than the vacuum level set in the embodiment of FIG. 3(*b*) for switch 65 to close. The reason for this arrangement of the switch 65 is that: if, as sometimes happens, the driver's foot rests on the accelerator pedal durng deceleration, the throttle valve remains slightly open and therefore manifold vacuum is maintained at a relatively low level although the engine is turning at a speed higher than 1600 rpm. Thus, in this embodiment, the control unit can be actuated at a lower manifold vacuum provided the engine speed exceeds 1600 rpm.

It will be apparent from the above description that the control unit of any embodiment is actuated in response to the engine operation parameter(s) which indicate the condition where the engine is driven by the vehicle at a high engine speed.

In connection with the aforementioned operation of the control unit 60, the carburetor according to the present invention operates as follows: Under the condition of the control unit 60 being actuated, as illustrated in FIG. 1, both the solenoid valve 51 and the solenoid valve 42 are actuated, the former being moved to block the slow fuel supply passage 15. Accordingly, fuel supply through the passage 15 is completely cut off, as long as the control unit is actuated. At the same time, the solenoid valve 42 is opened so that substantially atmospheric pressure prevails in the chamber 29. The air in the chamber 29 is passed around the valve head 35 into the chamber 33, whereupon the valve head 35 is moved to the seated position by the action of the diaphragm spring. Thus the pressure in the chamber 29 is maintained and is substantially equalized with the pressure in the chamber 28, the valve element 30 being kept at the position blocking the passage 21 by the action of the diaphragm spring (no numeral). It follows that no additional mixture is supplied through the by-pass passage, eliminating unnecessary fuel consumption and providing sufficient braking effect of the engine.

As soon as the engine speed and the manifold vacuum drops to the aforementioned values in the course of deceleration with the throttle valve still closed, the control unit 60 is then deactuated deenergizing both the solenoid valves 51 and 42. The slow fuel supply passage 15 is then opened and a calibrated mixture is allowed to flow downstream of the throttle valve 13. As best seen in FIG. 2, the solenoid valve 42 is now moved to block the air bleed 41. As a result, the intake manifold vacuum prevails in the chamber 33 to cause the valve head 35 to be unseated, the chamber 33 then communicating with the chamber 29. The high manifold vacuum is thus obtained in the chamber 29 because of the blockage of the air bleed 41. It may be noted that the orifice **29*a* is so calibrated that this high vacuum in the chamber 29 is maintained at a substantially constant level. Since, as described, atmospheric air pressure is dominant in the chamber 28, the valve head 30 is moved to the unseated position by the pressure differential across the diaphragm 27, whereupon the passage 21 freely opens to the intake manifold 18**. Thus a proper quantity of additional mixture is supplied into the intake manifold in this particular mode of deceleration.

If the engine idles after deceleration, the air bleed 41 is still closed by the deactuated solenoid valve 42, however the valve head 30 is permitted to resume a seated position in the following manner: whilst the manifold vacuum is fairly low during idling, atmospheric air is gradually passed into the chamber 29 through the orifice **29*a* to further lower the vacuum therein. The pressure in the chamber 29 therefore approximates atmospheric pressure, the valve head 30** thus returns to the seated position. Thus it will be readily understood that no additional mixture supply takes place in any engine operating mode other than this particular condition of deceleration described.

What is claimed is:

1. An improved carburetor with a slow fuel supply system for use with an internal combustion engine having an intake manifold, the carburetor comprising electric control means connected with a source of electric power and sensitive to the condition of the engine acting as a brake at an engine speed above a predetermined value and producing an electric signal indicating said condition, a solenoid-operated valve disposed in the slow fuel supply system and operatively connected with the control means to block the supply of fuel upon receiving said electric signal, a by-pass mixture supply passageway communicating between a source of mixture supply and the intake manifold for supplying the intake manifold with additional mixture, a diaphragm-operated valve assembly disposed in said passageway and operable by the intake manifold vacuum to open and close said passageway, and solenoid-operated means for actuating the diaphragm-operated valve assembly, said solenoid-operated means being operatively connected with said control means for feeding, upon receiving said electric signal, the diaphragm-operated valve assembly with the air cancelling the manifold vacuum causing said valve to close the passageway.

2. A carburetor as in claim 1, in which said diaphragm operated valve assembly comprises a diaphragm-operated pilot valve having a chamber being subjected to the intake manifold vacuum whereupon the valve is movable to an open position, a diaphragm-operated main valve having on the opposite sides of the diaphragm an air pressure chamber and another chamber subjectable to the vacuum prevalent in the chamber of the pilot valve when the pilot valve is opened whereupon the main valve is movable to an open position, and in which said solenoid-operated means comprises an air bleed communicating with said another chamber of the main valve and a solenoid valve located in said air bleed and being movable to a position blocking said air bleed when said signal stops and to another position opening said bleed to the atmosphere upon receiving said signal.

3. An improved carburetor as in claim 1, in which said electric control means comprises means sensitive to engine speed and another means sensitive to a throttle valve position for producing said electric signal both when the engine speed exceeds a predetermined value and when the throttle valve is in a substantially fully closed position.

4. An improved carburetor as in claim 1, in which said electric control means comprises means sensitive to intake manifold vacuum for producing said electric signal when the vacuum exceeds a predetermined value.

5. An improved carburetor as in claim 1, which said electric control means comprises means sensitive to intake manifold vacuum and another means sensitive to engine speed for producing said electric signal both when the manifold vacuum exceeds a predetermined value and when the engine speed exceeds a predetermined value.

* * * * *